US009341999B2

(12) United States Patent
Seshita et al.

(10) Patent No.: US 9,341,999 B2
(45) Date of Patent: May 17, 2016

(54) IMAGE FORMING APPARATUS WHICH ADJUSTS A TIME INTERVAL BETWEEN SUCCESSIVE RECORDING MEDIA AND THE CHANGING TIME AT WHICH THE TIME INTERVAL IS CHANGED

(71) Applicants: Takuya Seshita, Kanagawa (JP); Takeshi Yamamoto, Kanagawa (JP); Yasunori Ishigaya, Kanagawa (JP); Hajime Gotoh, Kanagawa (JP); Takahiro Imada, Kanagawa (JP); Akira Suzuki, Tokyo (JP)

(72) Inventors: Takuya Seshita, Kanagawa (JP); Takeshi Yamamoto, Kanagawa (JP); Yasunori Ishigaya, Kanagawa (JP); Hajime Gotoh, Kanagawa (JP); Takahiro Imada, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/619,327

(22) Filed: Feb. 11, 2015

(65) Prior Publication Data

US 2015/0261149 A1 Sep. 17, 2015

(30) Foreign Application Priority Data

Mar. 12, 2014 (JP) ..... 2014-048639
Jun. 16, 2014 (JP) ..... 2014-123199

(51) Int. Cl.
*G03G 15/20* (2006.01)

(52) U.S. Cl.
CPC .. *G03G 15/2042* (2013.01); *G03G 2215/00599* (2013.01); *G03G 2215/2045* (2013.01)

(58) Field of Classification Search
CPC ..... G03G 15/2046; G03G 15/2042
USPC ..... 399/68, 69
See application file for complete search history.

(56) References Cited

U.S. PATENT DOCUMENTS

| | | | | |
|---|---|---|---|---|
| 6,037,576 | A * | 3/2000 | Okabayashi et al. | 219/619 |
| 7,742,714 | B2 * | 6/2010 | Shinshi et al. | 399/68 |
| 8,755,733 | B2 * | 6/2014 | Ehara et al. | 399/400 |
| 9,026,024 | B2 | 5/2015 | Ogawa et al. | |
| 2007/0175880 | A1 * | 8/2007 | Iwasaki | G03G 15/2039 219/216 |
| 2007/0292175 | A1 | 12/2007 | Shinshi | |
| 2012/0237264 | A1 * | 9/2012 | Hirayama et al. | 399/237 |
| 2013/0148995 | A1 * | 6/2013 | Yoshikawa | G03G 15/2039 399/69 |
| 2013/0164015 | A1 * | 6/2013 | Kawai et al. | 399/69 |
| 2013/0195477 | A1 | 8/2013 | Seshita et al. | |
| 2013/0209119 | A1 | 8/2013 | Yuasa et al. | |

(Continued)

FOREIGN PATENT DOCUMENTS

| | | |
|---|---|---|
| JP | 4-044083 | 2/1992 |
| JP | 2001-183929 | 7/2001 |

(Continued)

*Primary Examiner* — Billy Lactaoen
*Assistant Examiner* — Arlene Heredia Ocasio
(74) *Attorney, Agent, or Firm* — Oblon, McClelland, Maier & Neustadt, L.L.L.P

(57) ABSTRACT

An image forming apparatus includes a fixing member, a heat source, a nip forming member, a pressing member, a recording medium conveyor, a first temperature detector to detect a temperature of a non-sheet-passing area of the fixing member through which a recording medium does not pass, a second temperature detector to detect a temperature of the recording medium, and a controller to adjust a time to drive the recording medium conveyer to control a time interval between successive recording media and a changing time to change the time interval, according to a temperature detected by the second temperature detector in response to a temperature rise in the non-sheet-passing area of the fixing member detected by the first temperature detector.

16 Claims, 8 Drawing Sheets

(56) References Cited

U.S. PATENT DOCUMENTS

| | | | | |
|---|---|---|---|---|
| 2013/0343791 | A1* | 12/2013 | Shimura | G03G 15/2053 399/329 |
| 2014/0016972 | A1 | 1/2014 | Seshita et al. | |
| 2014/0099138 | A1 | 4/2014 | Ishigaya et al. | |
| 2014/0133877 | A1 | 5/2014 | Samei et al. | |
| 2014/0133879 | A1 | 5/2014 | Seshita et al. | |
| 2014/0270834 | A1 | 9/2014 | Seshita et al. | |
| 2014/0369703 | A1 | 12/2014 | Hase et al. | |

FOREIGN PATENT DOCUMENTS

| | | |
|---|---|---|
| JP | 2002-023556 | 1/2002 |
| JP | 2002-169413 | 6/2002 |
| JP | 2004-286922 | 10/2004 |
| JP | 2007-334205 | 12/2007 |
| JP | 2009-075443 | 4/2009 |
| JP | 2012-145700 | 8/2012 |
| JP | 2012-220825 | 11/2012 |

* cited by examiner

IMAGE FORMING APPARATUS WHICH ADJUSTS A TIME INTERVAL BETWEEN SUCCESSIVE RECORDING MEDIA AND THE CHANGING TIME AT WHICH THE TIME INTERVAL IS CHANGED

CROSS-REFERENCE TO RELATED APPLICATIONS

This patent application is based on and claims priority pursuant to 35 U.S.C. §119(a) to Japanese Patent Application Nos. 2014-048639, filed on Mar. 12, 2014, and 2014-123199, filed on Jun. 16, 2014, in the Japan Patent Office, the entire disclosure of each of which is hereby incorporated by reference herein.

BACKGROUND

1. Technical Field

Embodiments of the present invention generally relate to an image forming apparatus for forming an image on a recording medium.

2. Background Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium.

SUMMARY

In one embodiment of the present invention, an improved image forming apparatus is described that includes a fixing member, a heat source to heat the fixing member, a nip forming member disposed inside the fixing member, a pressing member pressed against the nip forming member through the fixing member to form a fixing nip through which a recording medium passes, a recording medium conveyor to convey the recording medium to the fixing nip, a first temperature detector to detect a temperature of a non-sheet-passing area of the fixing member through which the recording medium does not pass, a second temperature detector to detect a temperature of the recording medium, and a controller to adjust a time to drive the recording medium conveyer to control a time interval between successive recording media and a changing time to change the time interval, according to a temperature detected by the second temperature detector in response to a temperature rise in the non-sheet-passing area of the fixing member detected by the first temperature detector.

In another embodiment of the present invention, an improved image forming apparatus is described that includes a fixing member, a heat source to heat the fixing member, a pressing member to form, together with the fixing member, a fixing nip through which a recording medium passes, a nip forming member, disposed inside the pressing member, facing the fixing member to form the fixing nip, a recording medium conveyor to convey the recording medium to the fixing nip, a first temperature detector to detect a temperature of a non-sheet-passing area of the fixing member through which the recording medium does not pass, a second temperature detector to detect a temperature of the recording medium, and a controller to adjust a time to drive the recording medium conveyer to control a time interval between successive recording media and a changing time to change the time interval, according to a temperature detected by the second temperature detector in response to a temperature rise in the non-sheet-passing area of the fixing member detected by the first temperature detector.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
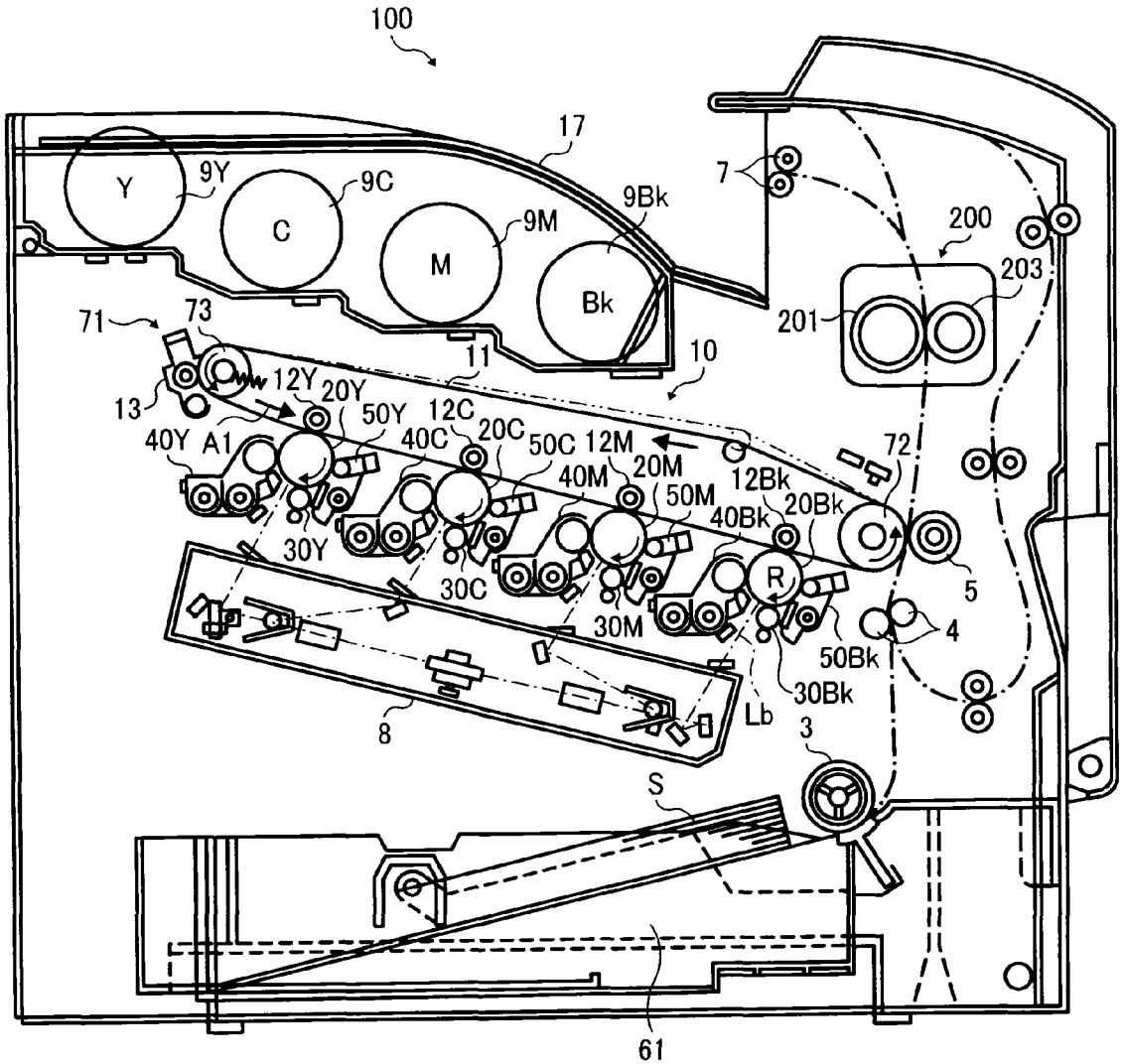
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes Y, C, M, and Bk denote colors yellow, cyan, magenta, and black, respectively. To simplify the description, these suffixes are omitted unless necessary.

Referring now to the drawings, wherein like reference numerals designate identical or corresponding parts throughout the several views, embodiments of the present invention are described below.

Initially with reference to FIG. 1, a description is given of an image forming apparatus 100 according to an embodiment of the present invention. FIG. 1 is a schematic view of the image forming apparatus 100.

In the present embodiment, the image forming apparatus 100 is a color printer. Alternatively, in some embodiments, the image forming apparatus 100 is a copier, a facsimile machine, or the like.

As illustrated in FIG. 1, the image forming apparatus 100 employs a tandem configuration in which drum-shaped photoconductors 20Y, 20C, 20M, and 20Bk are arranged side by side, in that order, along a transfer belt 11 that rotates in a direction indicated by arrow A1 (hereinafter referred to as direction A1). The photoconductors 20Y, 20C, 20M, and 20Bk serve as image bearers to bear images corresponding to yellow, cyan, magenta, and black, respectively, after color separation.

Each of the photoconductors 20 is surrounded by various devices in an imaging station to form a toner image while each of the photoconductors 20 is rotating. Specifically, for example, the photoconductor 20Bk is surrounded by a charger 30Bk, a developing device 40Bk, and a cleaner 50Bk in its imaging station, and by a first transfer roller 12Bk disposed between the developing device 40Bk and the cleaner 50Bk. These devices are disposed, in that order, in a direction indicated by arrow R in which the photoconductors 20 rotate. While the photoconductor 20Bk is rotating, a black toner image is formed on the photoconductor 20Bk and transferred onto the transfer belt 11.

Below the four imaging stations including, e.g., photoconductors 20, an optical writing device 8 is disposed facing the four imaging stations to irradiate the photoconductors 20 with laser beams Lb after the photoconductors 20 are charged. The optical writing device 8 includes, e.g., a semiconductor laser as a light source, a coupling lens, an fθ lens, a toroidal lens, a turning mirror, and a polygon mirror as a deflector. The optical writing device 8 emits the laser beams Lb corresponding to the respective colors to the photoconductors 20Y, 20C, 20M, and 20Bk to form latent images thereon. To simplify FIG. 1, reference numeral "Lb" is assigned only to the laser beam emitted to the photoconductor 20Bk. Thus, visible toner images formed on the photoconductors 20 are transferred onto the transfer belt 11 serving as an intermediate transfer body in a primary transfer process.

The transfer belt 11 is an endless belt that rotates in the direction A1 while facing the photoconductors 20Y, 20C, 20M, and 20Bk. Specifically, in the primary transfer process, the toner images are transferred onto the transfer belt 11 rotating in the direction A1 at different times starting from the most upstream photoconductor, in this case the photoconductor 20Y, so that the toner images are superimposed one atop another at the same position on the transfer belt 11 to form a full-color toner image, with voltage applied by primary transfer rollers 12Y, 12C, 12M, and 12Bk disposed facing the respective photoconductors 20Y, 20C, 20M, and 20Bk through the transfer belt 11. The toner images thus transferred onto the transfer belt 11 are then together transferred onto a recording sheet S serving as a recording medium in a secondary transfer process.

The image forming apparatus 100 includes a transfer belt unit 10 provided above the photoconductors 20, a secondary transfer roller 5, and a belt cleaner 13. The transfer belt unit 10 includes the transfer belt 11 and the primary transfer rollers 12. The secondary transfer roller 5 serving as a transfer member is disposed facing the transfer belt 11 and rotates in association with rotation of the transfer belt 11. The belt cleaner 13 is disposed facing the transfer belt 11 to clean the transfer belt 11. The transfer belt unit 10 includes a drive roller 72 and a driven roller 73 in addition to the transfer belt 11 and the primary transfer rollers 12. The transfer belt 11 is entrained around the drive roller 72 and the driven roller 73.

The driven roller 73 is provided with a biasing member such as a spring that presses the driven roller 73 against the transfer belt 11. Thus, the driven roller 73 has a biasing function to keep the tension of the transfer belt 11. The transfer belt unit 10, the secondary transfer roller 5, and the belt cleaner 13 together constitute a transfer unit 71.

The belt cleaner 13 includes a cleaning brush and a cleaning blade that faces and contacts the transfer belt 11 to clean the transfer belt 11 by scraping foreign substances such as residual toner off the transfer belt 11. The belt cleaner 13 also includes an ejection member that ejects the foreign substances removed from the transfer belt 11.

The image forming apparatus 100 also includes a sheet feeder 61, which is a tray to accommodate a plurality of recording sheets S and is disposed in a lower portion of the image forming apparatus 100. The sheet feeder 61 includes a feeding roller 3 that contacts a top surface of the uppermost one of the recording sheets S to feed the uppermost recording sheet S toward a pair of registration rollers 4 as the feeding roller 3 is rotated in a counterclockwise direction. The pair of registration rollers 4 sends the recording sheet S conveyed from the sheet feeder 61 toward a secondary transfer position between the transfer belt 11 and the secondary transfer roller 5 at a predetermined time so that the full-color toner image can be transferred onto the recording sheet S at the secondary transfer position. The image forming apparatus 100 also includes a sensor to detect that a leading end of the recording sheet S reaches the pair of registration rollers 4.

The image forming apparatus 100 also includes a fixing device 200, a pair of ejection rollers 7 located downstream from the fixing device 200 in a recording media conveyance direction in which the recording media are conveyed, an ejection tray 17, and toner bottles 9Y, 9C, 9M, and 9Bk. The fixing device 200 includes an endless fixing belt 201 and a pressing roller 203. After the full-color toner image is transferred onto the recording sheet S, the fixing device 200 fixes the full-color toner image onto the recording sheet S. Then, the pair of ejection rollers 7 ejects the recording sheet S outside the body of the image forming apparatus 100, more specifically, onto the ejection tray 17 at the top of the body of the image forming apparatus 100. The four toner bottles 9Y, 9C, 9M, and 9Bk are positioned below the ejection tray 17, and contain yellow, cyan, magenta, and black toner, respectively.

Figure 2:
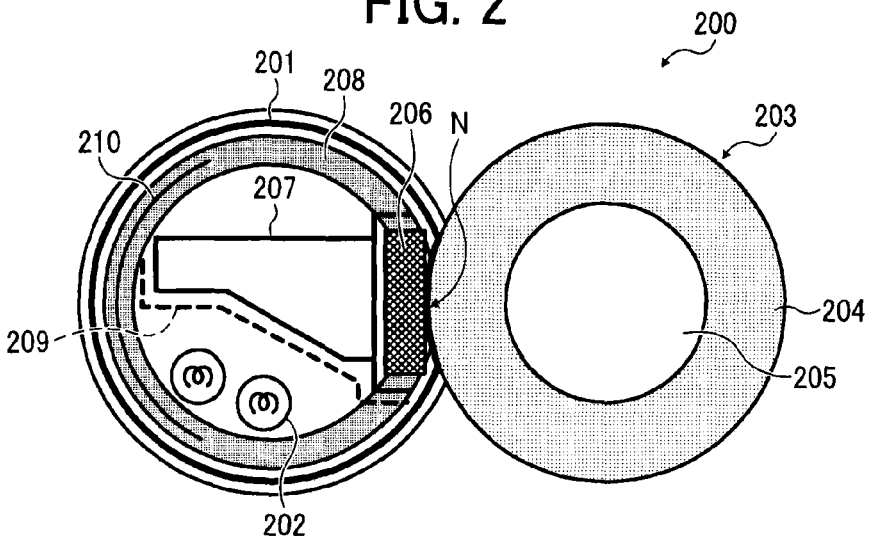
FIG. 2 is a schematic sectional view of a fixing device incorporated in the image forming apparatus, according to a first example of a first embodiment of the present invention.

Referring now to FIG. 2, a description is given of the fixing device 200 according to a first example of a first embodiment of the present invention. FIG. 2 is a schematic sectional view of the fixing device 200.

As illustrated in FIG. 2, the fixing device 200 includes the fixing belt 201 serving as a fixing member, the pressing roller 203 serving as a pressing member, and two halogen heaters 202 serving as heat sources. The halogen heaters 202 directly heat the fixing belt 201 from inside the fixing belt 201.

The fixing device 200 further includes a nip forming member 206 inside a loop formed by the fixing belt 201. The nip forming member 206 faces and is pressed by the pressing roller 203 through the fixing belt 201, thereby forming a contact area called a fixing nip N between the fixing belt 201 and the pressing roller 203. The fixing belt 201 slides over the nip forming member 206 directly, or indirectly via a sheet of material. It is to be noted that although in the embodiment illustrated in FIG. 2 the fixing nip N is flat, in other embodiments the fixing nip may have a concave shape or some other shapes. One advantage of a concave fixing nip is that it enhances separation of the recording medium from the fixing member (e.g., fixing belt 201) because the recording medium is ejected from the fixing nip toward the pressing member (e.g., pressing roller 203), thereby preventing the recording medium from being jammed.

As noted above, the fixing belt 201 is an endless belt or film. Specifically, the fixing belt 201 may be a metal belt made of, e.g., nickel or stainless steel, or a belt made of resin material such as polyimide. A surface layer of the fixing belt 201 includes a release layer made of, e.g., perfluoroalkoxy alkanes (PFA) or polytetrafluoroethylene (PTFE) to prevent toner from adhering to the fixing belt 201.

In some embodiments, the fixing belt 201 includes an elastic layer made of, e.g., silicone rubber between a base material of the fixing belt 201 and the release layer. Omitting the elastic layer made of silicone rubber reduces heat capacity and enhances fixability. However, the slight surface roughness of the fixing belt 201 may be transferred onto a recording medium while a toner image is fixed onto the recording medium, causing an orange-peel image, which is an image having uneven gloss in a solid part thereof. An elastic layer made of silicone rubber of 100 μm or greater may prevent such a problem. Deformation of such elastic layer absorbs the slight surface roughness and avoids an orange-peel image.

Inside the loop formed by the fixing belt 201, a stay 207 serving as a support member is disposed to support the nip forming member 206. The stay 207 prevents deformation of the nip forming member 206 that is pressed by the pressing roller 203 so that the fixing nip N maintains an even width axially along the fixing belt 201 and the pressing roller 203. The stay 207 is secured in position by a flange 208 at opposed ends. In the present embodiment, the fixing device 200 further includes a reflecting member 209 disposed between the halogen heaters 202 and the stay 207 to prevent the stay 207 from being heated by the halogen heaters 202, thereby enhancing energy efficiency. In some embodiments, instead of incorporating the reflecting member 209 in the fixing device 200, the stay 207 has a heat-insulated surface or mirror-finished surface. Additionally, although in the embodiment illustrated in FIG. 2 the halogen heaters 202 serve as heat sources, in other embodiments, e.g., an induction heater, a resistance heat generator, or a carbon heater may serve as a heat source. A curved, movable shield 210 is provided inside the loop formed by the fixing belt 201. A detailed description of the movable shield 210 is deferred.

In the present embodiment, the pressing roller 203 is constituted of an elastic layer 204 and a bar core 205, with a release layer made of PFA or PTFE provided on an outer circumferential surface of the pressing roller 203 to enhance separation. A drive source such as a motor incorporated in the image forming apparatus 100 transmits a driving force to the pressing roller 203 through gears, thereby rotating the pressing roller 203. The elastic layer 204 is deformed while the pressing roller 203 is pressed against the fixing belt 201 by, e.g., a spring. Such deformation of the elastic layer 204 forms the fixing nip N having a predetermined width. Alternatively, in some embodiments, the pressing roller 203 is a hollow roller, and may include a heat source such as a halogen heater. In some embodiments, the elastic layer 204 is made of solid rubber. If a heater is not disposed inside the pressing roller 203, the elastic layer 204 may be made of sponge rubber to enhance efficiency of heat insulation and prevent dissipation of heat from the fixing belt 201.

The rotation of the pressing roller 203 rotates the fixing belt 201. In the present embodiment, the pressing roller 203 is rotated by a drive source, and a driving force is transmitted to the fixing belt 201 at the fixing nip N to rotate the fixing belt 201. Specifically, a portion of the fixing belt 201 is sandwiched between the pressing roller 203 and the nip forming member 206 at the fixing nip N, while the rest of the fixing belt 201 is guided by the flange 208 at opposed ends. Accordingly, the fixing belt 201 rotates.

The fixing device 200 having the above-described configuration speeds warm-up and is inexpensive.

Figure 3:
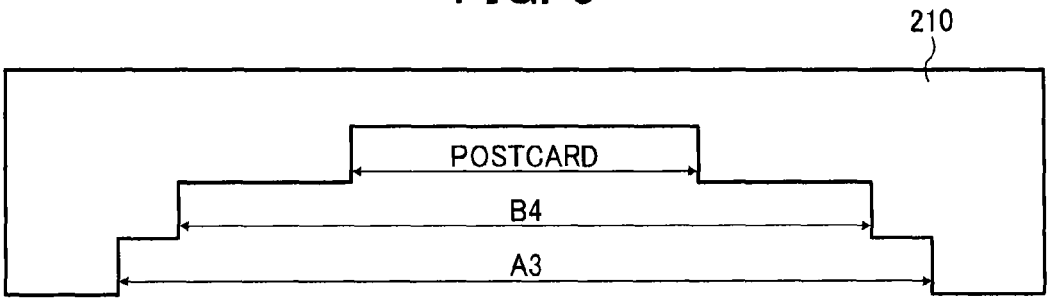
FIG. 3 is a plan view of a movable shield incorporated in the fixing device.

Referring now to FIG. 3, a description is given of the movable shield 210. FIG. 3 is a plan view of the movable shield 210.

As illustrated in FIG. 3, the movable shield 210 has a non-shielding part conforming to different sizes of recording media. The movable shield 210 blocks heat from the halogen heaters 202 to prevent a temperature rise at ends of the fixing belt 201, more specifically, in non-sheet-passing areas of the fixing belt 201 through which recording media do not pass.

It is to be noted that, as illustrated in FIG. 2, the movable shield 210 is curved along the inner circumferential surface of the fixing belt 201, and is movable in a circumferential direction of the fixing belt 201. In the present embodiment, the fixing device 200 has a direct heating area where the halogen heaters 202 face and heat the fixing belt 201 directly, and an indirect heating area where the halogen heaters 202 heat the fixing belt 201 indirectly through, e.g., the reflecting member 209. To block heat, the movable shield 210 is disposed at a shielding position in the direct heating area as illustrated in FIG. 2, and is retractable to a position in the indirect heating area not to block heat. The movable shield 210 is made of, e.g., ceramic or metal material such as aluminum, iron, or stainless steel to enhance heat resistance.

Figure 4:
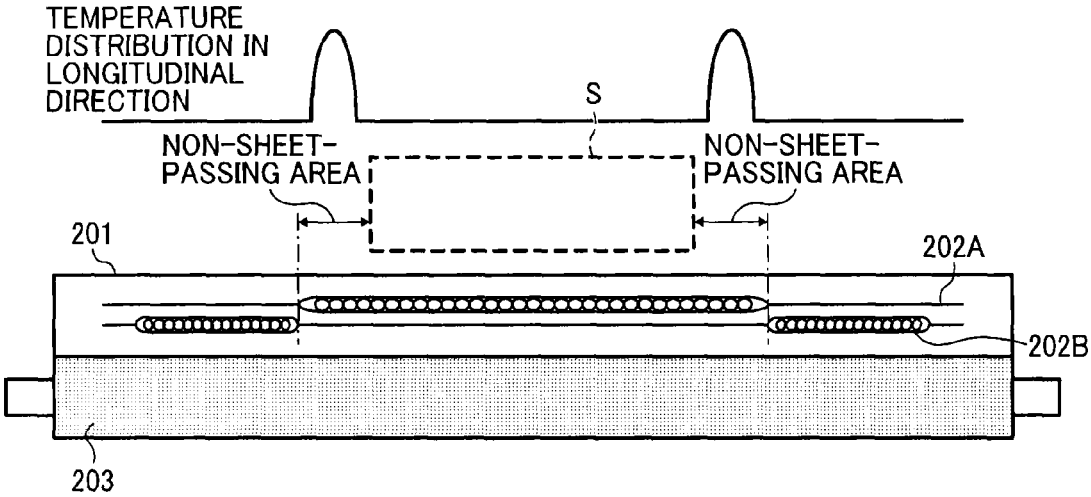
FIG. 4 is a schematic diagram illustrating a temperature rise in non-sheet-passing areas of a fixing member incorporated in the fixing device.

As illustrated in FIG. 4, the two halogen heaters 202 include a central heater 202A and an end heater 202B. In the present embodiment, a recording sheet S serving as a recording medium is conveyed centrally. The central heater 202A has a heat-generating area in the center in a width direction of the recording sheet S, which is a direction perpendicular to the recording media conveyance direction in which the recording sheet S is conveyed. When the recording sheet S having a predetermined width or a smaller width is conveyed, the central heater 202A is used alone. For example, when a Letter-size recording sheet S or a recording sheet S having a smaller size is conveyed in a longitudinal direction thereof, the central heater 202A is used alone. The end heater 202B has heat-generating areas outside opposed ends of the recording sheet S in the width direction thereof. The end heater 202B is used with the central heater 202A when the recording sheet S having a greater width than the predetermined width is conveyed. For example, when a recording sheet S having a greater width than the Letter-size recording sheet S is conveyed, the end heater 202B is used with the central heater 202A.

Usually, in fixing devices having two heaters as illustrated in FIG. 2, the heaters are separated from each other, as described above, to prevent a temperature rise in non-sheet-passing areas of the fixing member (e.g., fixing belt) through which a sheet does not pass. For example, when an A3-, A4-, or Letter-size recording sheet is conveyed in the longitudinal direction thereof, a central heater is used alone to fix a toner image on the sheet, thereby preventing a temperature rise in the non-sheet-passing areas of the fixing member. On the other hand, when a B4-size recording sheet or a postcard is conveyed, the movable shield 210 is used to prevent a temperature rise in the non-sheet-passing areas of the fixing member because high frequency of use of B4-size recording sheets or postcards may cause an undesirable temperature rise in the non-sheet-passing areas of the fixing member and reduce productivity.

However, if, e.g., an A5-size recording sheet is conveyed in the fixing devices having the above-described configuration, the temperature may rise in the non-sheet-passing areas of the fixing member. FIG. 4 illustrates such a temperature rise in the non-sheet-passing areas of the fixing member as a temperature distribution in a longitudinal direction of the fixing member (i.e. fixing belt 201).

Figure 5:
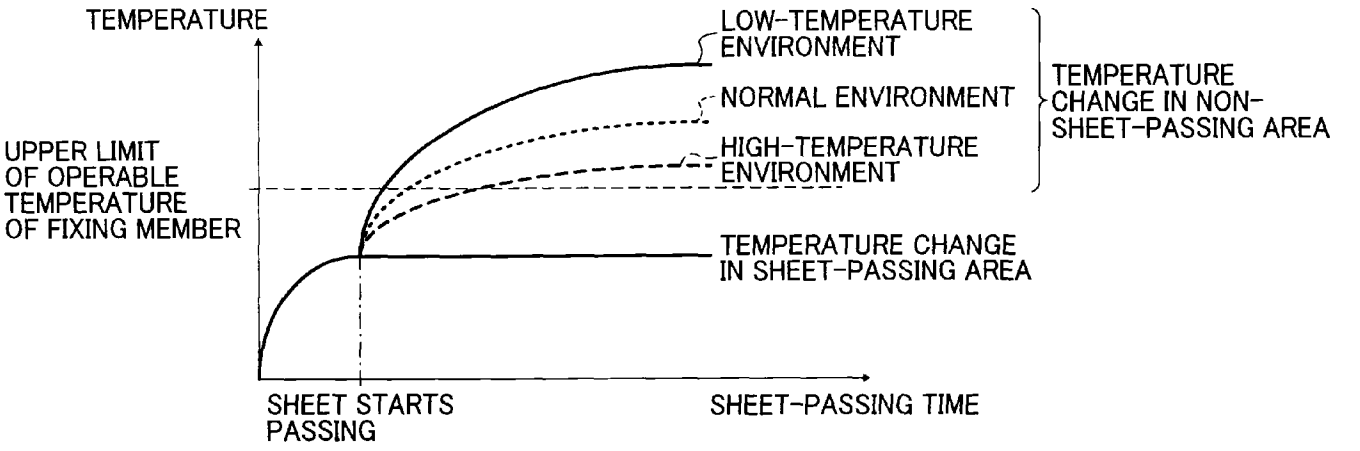
FIG. 5 is a graph illustrating changes in temperature of a recording medium depending on the environment.

FIG. 5 is a graph illustrating changes in temperature of a recording medium depending on the environment. As illustrated in FIG. 5, the temperature soars in response to a low-temperature environment of the recording medium. Specifically, after the recording medium starts passing through the fixing device, the temperature of the non-sheet-passing areas of the fixing member increases compared to the temperature of a sheet-passing areas of the fixing member through which the recording medium passes, and exceeds an upper limit of the operable temperature of the fixing belt 201.

Figure 6:
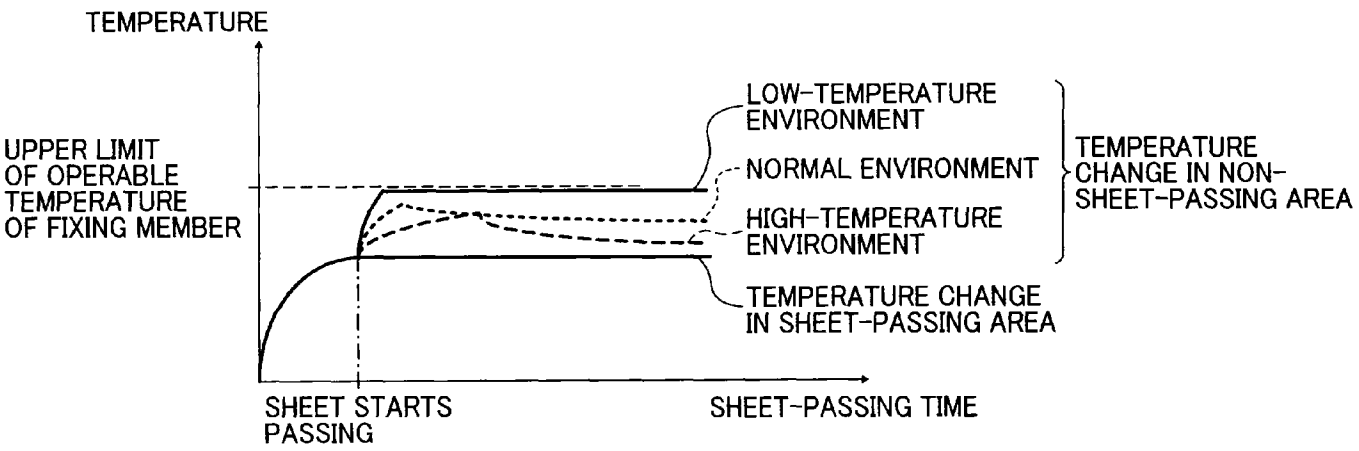
FIG. 6 is a graph illustrating changes in temperature of a recording medium depending on the environment resulting from conventional control.

FIG. 6 is a graph illustrating changes in temperature of a recording medium depending on the environment resulting from conventional control. In a conventional control regime, a target fixing temperature is increased and an interval between successive recording media is extended to reduce the number of recording media conveyed per hour when the temperature of recording media is relatively low. FIG. 6 illustrates how the temperature of the fixing member does not reach the upper limit of the operable temperature of the fixing member in a normal environment or high-temperature environment in which the recording media are relatively warm. In other words, heat dissipates inefficiently, adversely affecting productivity.

Figure 7A:
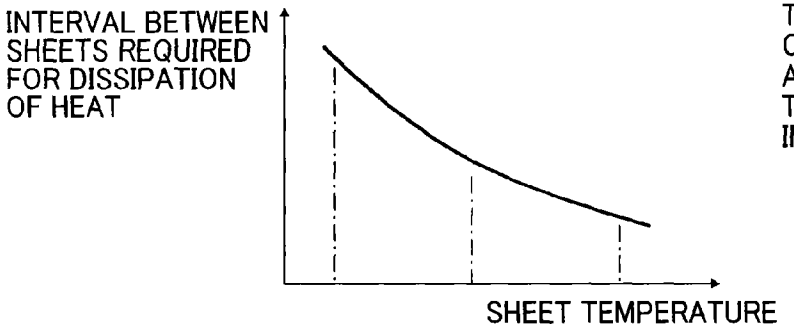
FIG. 7A is a graph illustrating a relationship between temperature of a recording medium and interval between successive recording media required for dissipation of heat according to embodiments of the present invention.
Figure 7B:
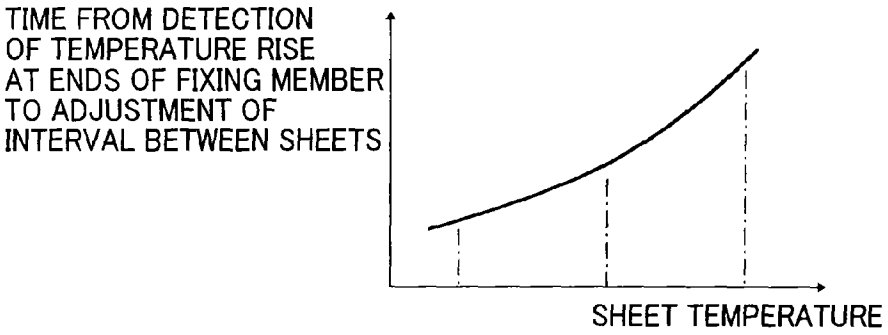
FIG. 7B is a graph illustrating a relationship between temperature of the recording medium and time from detection of a temperature rise at ends of a fixing member incorporated in the fixing device to adjustment of interval between successive recording media according to embodiments of the present invention.

By contrast, according to embodiments of the present invention, a sheet interval (i.e., a period of time marked off between two recording media conveyed successively) required for dissipation of heat, and a time to change the sheet interval are adjusted according to the sheet temperature (i.e., temperature of a recording medium), as illustrated in FIGS. 7A and 7B.

FIG. 7A is a graph illustrating a relationship between the sheet temperature and the sheet interval required for dissipation of heat according to embodiments of the present invention. The horizontal axis indicates the sheet temperature while the vertical axis indicates the sheet interval. FIG. 7B is a graph illustrating a relationship between the sheet temperature and the time from detection of a temperature rise at ends of the fixing belt 201 to adjustment of sheet interval according to embodiments of the present invention. The horizontal axis indicates the sheet temperature while the vertical axis indicates the time from detection of a temperature rise at ends of the fixing belt 201 to adjustment of the sheet interval.

Figure 8:
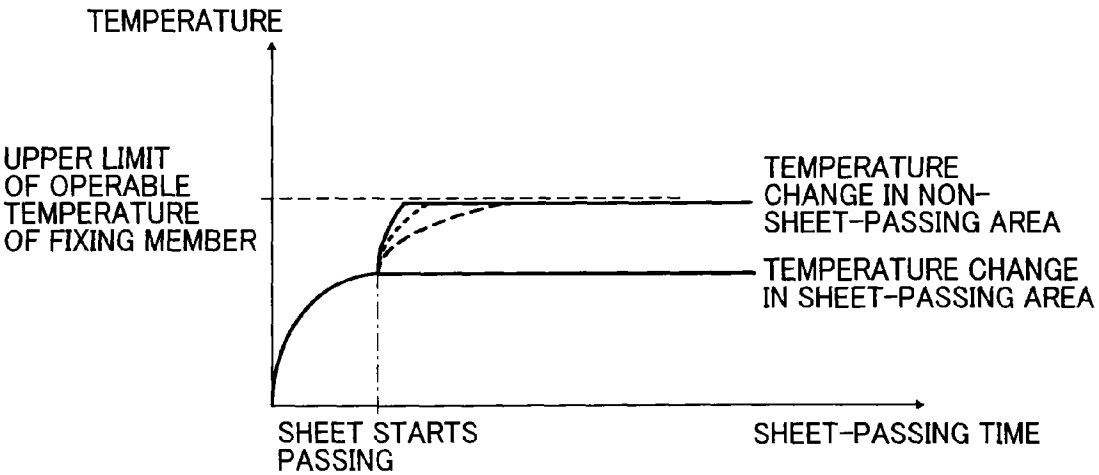
FIG. 8 is a graph illustrating changes in temperature of the recording medium depending on the environment according to embodiments of the present invention.

FIG. 8 is a graph illustrating changes in temperature of a recording medium depending on the environment according to embodiments of the present invention. After the recording medium starts passing through the fixing device 200, the temperature of the non-sheet-passing area of the fixing belt 201 becomes higher than the temperature of the sheet-passing area of the fixing belt 201. After a predetermined period of time elapses, the non-sheet-passing area of the fixing belt 201 is at a constant temperature close to the upper limit of the operational temperature of the fixing belt 201 regardless of the sheet temperature (ambient temperature). As a result, productivity is enhanced in the normal or high-temperature environment in which recording media are relatively warm.

Figure 9:
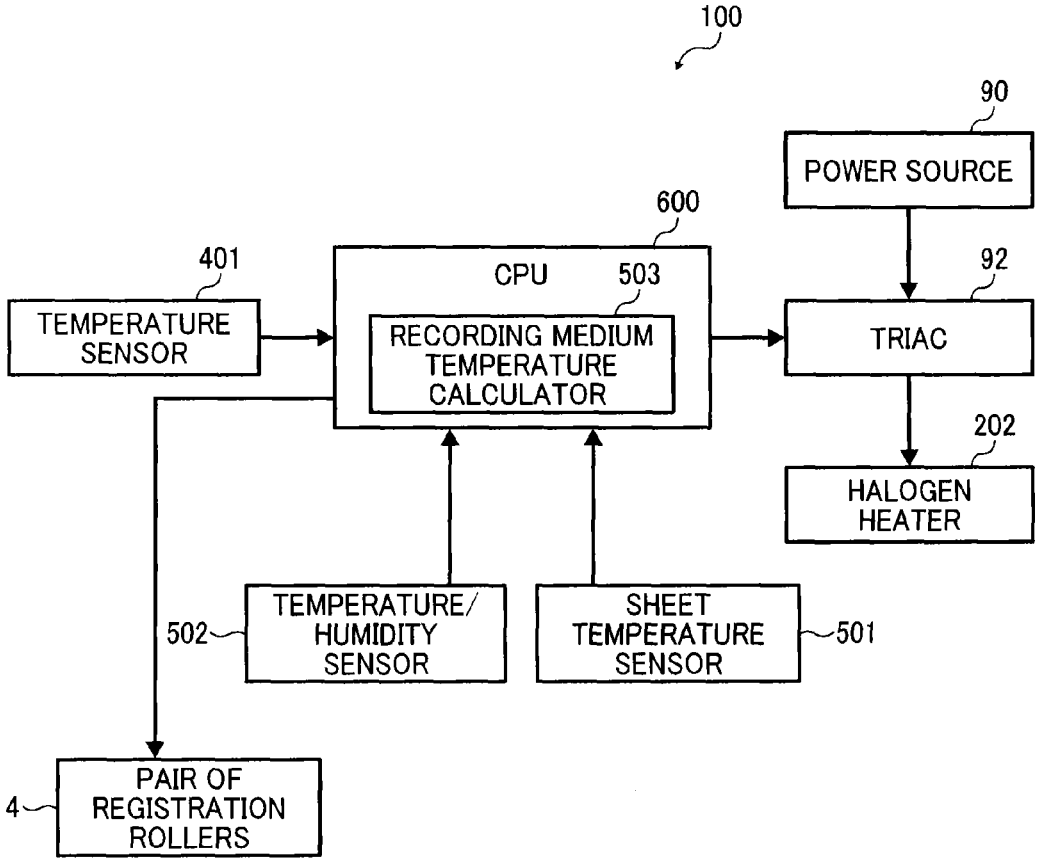
FIG. 9 is a functional block diagram of a controller incorporated in the image forming apparatus.

Referring now to FIG. 9, a description is given of operation of embodiments of the present invention. FIG. 9 is a functional block diagram of a central processing unit (CPU) 600 serving as a controller incorporated in the image forming apparatus 100. As illustrated in FIG. 9, the CPU 600 is operatively connected to devices such as sensors described later, which are used for operation of embodiments of the present invention, to adjust a predetermined sheet interval and a predetermined time to change the sheet interval according to a detected sheet temperature by adjusting the time to drive, e.g., the feeding roller 3 or the pair of registration rollers 4 serving as a recording media conveyor.

First, a detailed description is given of adjusting a predetermined sheet interval according to the sheet temperature by the CPU 600.

The predetermined sheet interval is a reference sheet interval, which is set at any point as a reference point in FIG. 7A. With respect to the reference point, the sheet interval is lengthened when the sheet temperature is lower than the temperature at the reference point and shortened when the sheet temperature is higher than the temperature at the reference point. For example, at a reference sheet temperature of 23° C. with a sheet interval of 2 seconds, the sheet interval is set to 3 seconds when the sheet temperature is 10° C. On the other hand, the sheet interval is set to 1 second when the sheet temperature is 32° C. These temperatures and times are usually determined for individual fixing devices.

Now, a detailed description is given of adjusting a predetermined time to change the sheet interval according to the sheet temperature by the CPU 600.

The predetermined time to change the sheet interval is a reference time to change the sheet interval, which is set at any point as a reference point in FIG. 7B. With respect to the reference point, the time to change the sheet interval is set earlier when the sheet temperature is lower than the temperature at the reference point and shortened when the sheet temperature is higher than the temperature at the reference point. For example, at a reference sheet temperature of 23° C. with a time to adjust the sheet interval of 10 seconds, the time from detection of a temperature rise to adjustment of the sheet interval is set to 0 second when the sheet temperature is 10° C. On the other hand, the time from detection of a temperature rise to adjustment of the sheet interval is set to 15 seconds when the sheet temperature is 32° C. These temperatures and times are usually determined for individual fixing devices.

In embodiments of the present invention, either or both the above-described sheet interval and the above-described time to adjust the interval are adjusted.

A description is now given of detection of the temperature of the non-sheet-passing areas of the fixing belt 201, more specifically, a temperature rise in the non-sheet-passing areas of the fixing belt 201. For example, as a first temperature detector, a temperature sensor 401 is used to detect a temperature rise in the non-sheet-passing areas of the fixing belt 201. It is to be noted that the detection of a temperature rise in the non-sheet-passing areas of the fixing belt 201 can be of any type, provided that the temperature is detected accurately.

The temperature sensor 401 is disposed in the non-sheet-passing area of the fixing belt 201 and in a heating area of a heat source or near the heating area.

The temperature sensor 401 is, e.g., a non-contact temperature sensor to measure the temperature of the non-sheet-passing area of the fixing belt 201, because a contact temperature sensor may damage the surface of the fixing member and cause defective images such as a gloss streak.

Instead of using the temperature sensor 401, the temperature rise in the non-sheet-passing areas of the fixing belt 201 is predicted based on, e.g., heater duty (i.e., power supply from a power source 90 to each of the halogen heaters 202 through a corresponding triac 92) at different times. The predicted temperature rise is thus substituted for a temperature rise detected by the temperature sensor 401. Specifically, the temperature rise in the non-sheet-passing areas of the fixing belt 201 is sequentially predicted by inputting heater duty (i.e., power supply) and an inside temperature of the fixing device 200 while a recording medium passes through the fixing device 200 with respect to a model created in advance.

Yet, instead of using the temperature sensor 401, the temperature rise in the non-sheet-passing areas of the fixing belt 201 is predicted by usage of the image forming apparatus 100, based on paper thickness, heater duty, process linear velocity, or the like. The temperature rise thus predicted is substituted for a temperature rise detected by the temperature sensor 401.

In the present embodiment, to ensure detection accuracy, the temperature sensor 401 is used to directly monitor the temperature rise. On the other hand, prediction of a temperature rise obviates the need to incorporate the temperature sensor 401 in the image forming apparatus 100, resulting in reduction of production costs.

A description is now given of detection of the temperature of a recording medium (i.e., sheet temperature). For example, as a second temperature detector, a recording medium temperature detector (e.g., sheet temperature sensor 501), an ambient temperature detector (e.g., temperature/humidity sensor 502), and/or a recording medium temperature calculator (e.g., recording medium temperature calculator 503) are used to detect the sheet temperature.

The recording medium temperature detector is, e.g., a non-contact temperature sensor such as a dissipation temperature sensor, taking into account thermal responsiveness and detection errors, or a temperature sensor that detects the temperature of a measurement object with measurement of self-temperature. The non-contact temperature sensor prevents adverse effects on the conveyance of a recording medium from the frictional heat.

On the other hand, a contact temperature sensor may affect conveyance of a recording medium because it contacts the recording medium and frictional heat is generated between the contact temperature sensor and the recording medium. Accordingly, if a contact temperature sensor is used, a backing material or the like may be used with the contact temperature sensor at the contact position, taking into account the frictional heat for control.

The recording medium temperature detector is disposed to directly measure the sheet temperature before a recording medium enters the fixing device 200, and preferably, immediately before the recording medium enters the fixing device 200.

The recording medium temperature detector may be disposed to directly measure the temperature of a recording medium placed on the sheet feeder 61 or a bypass tray. If a contact temperature sensor is used, the contact temperature sensor measures the temperature of the recording medium placed on the sheet feeder 61 or a bypass tray before conveyance because measurement while the recording medium is moving may be affected by the frictional heat.

Instead of using the recording medium temperature detector, the sheet temperature is indirectly obtained using an ambient temperature detector that detects ambient temperature as a second temperature detector. Generally, the temperature of recording media placed on the sheet feeder 61 is the same as the ambient temperature of the image forming apparatus 100. In other words, the sheet temperature is indirectly measured by measurement of the ambient temperature of the image forming apparatus 100, thereby obviating the need to incorporate the recording medium temperature detector in the image forming apparatus 100, resulting in reduction of production costs.

Yet, instead of using the recording medium temperature detector, the sheet temperature is indirectly obtained using a recording medium temperature calculator 503 as a second temperature detector. The recording medium temperature calculator 503 calculates a sheet temperature predicted based on a duty ratio of power supplied to the halogen heaters 202 while a recording medium passes through the fixing device. In short, the sheet temperature is indirectly obtained based on the heater duty (i.e., duty ratio). Specifically, the amount of heat drained by the recording medium fluctuates according to the sheet temperature. As a result, the heater duty also fluctuates. For example, the lower the sheet temperature is, the higher the heater duty is while the recording medium passes through the fixing device 200. Accordingly, the sheet temperature is predicted by comparing a measured heater duty with the heater duty ascertained in advance depending on the sheet temperature. Thus, the sheet interval and the time to change the sheet interval are adjusted using the predicted sheet temperature, resulting in reduction of production costs.

It is to be noted that the heater duty is affected by, e.g., fluctuation of heater output or power supply voltage (i.e., voltage supplied to the heater) because of a constant amount of heat drained by the recording medium. To enhance accuracy of predicting the sheet temperature, the heater output is calibrated upon assembly of the fixing device 200 and stored in the image forming apparatus 100. Taking into account the heater output, an actual heater duty is corrected to predict a sheet temperature. The power supply voltage is detected in a typical way and taken into account for calculation of a sheet temperature.

For example, if the heater power is greater than a target value, the heater duty decreases. Accordingly, the heater duty is increased to be used for prediction of a sheet temperature. By contrast, if the heater power is smaller than the target value, the heater duty increases. Accordingly, the heater duty is decreased to be used for prediction of a sheet temperature. Similarly, if the power supply voltage is lower than a target value, the heater duty increases. Accordingly, the heater duty is decreased to be used for prediction of a sheet temperature. By contrast, if the power supply voltage is higher than the target value, the heater duty decreases. Accordingly, the heater duty is increased to be used for prediction of a sheet temperature.

It is to be noted that the detection of the sheet temperature is not limited to the above-described examples provided that the sheet temperature is detected as appropriate. In some embodiments, the above-described examples are used together to detect the sheet temperature.

Figure 10:
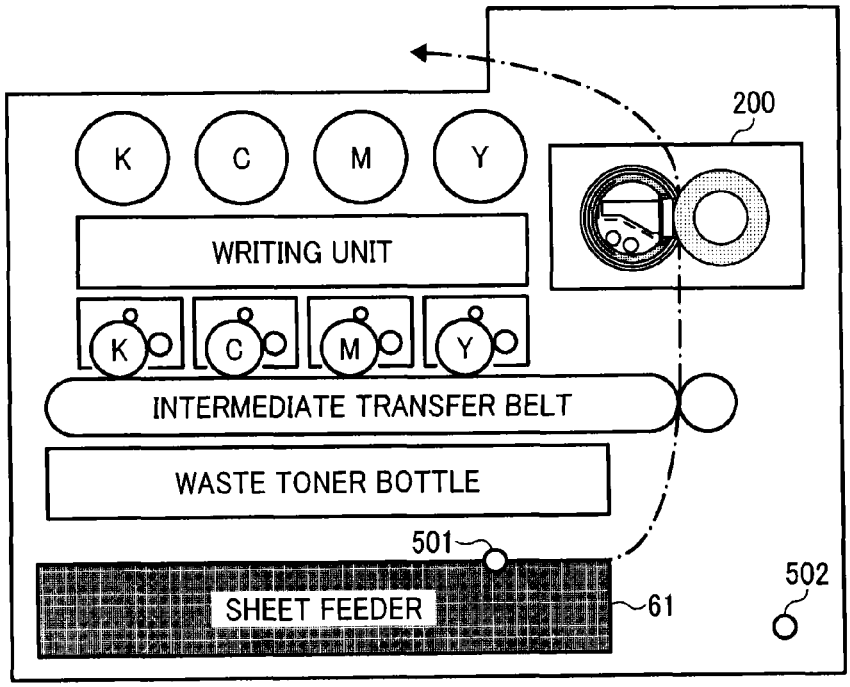
FIG. 10 is a schematic front view of an image forming apparatus according to an embodiment of the present invention incorporating a sheet temperature sensor and a temperature/humidity sensor.
Figure 11:
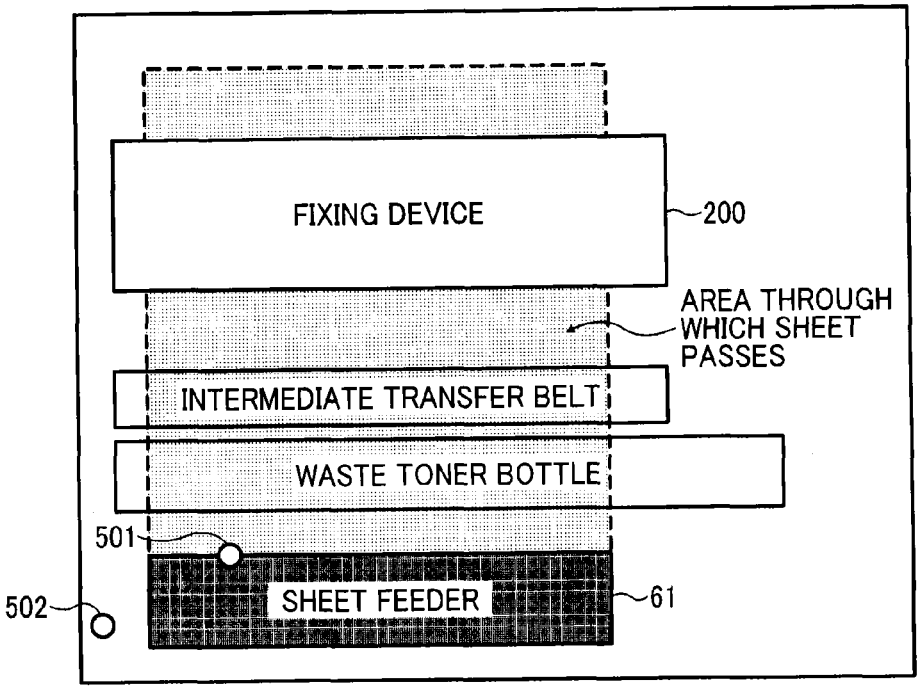
FIG. 11 is a schematic side view of the image forming apparatus incorporating the sheet temperature sensor and the temperature/humidity sensor.

Referring now to FIGS. 10 and 11, a description is given of an example of the recording medium temperature detector and the ambient temperature detector described above. FIG. 10 is a schematic front view of an image forming apparatus according to an embodiment of the present invention incorporating a sheet temperature sensor 501 serving as a recording medium temperature detector and a temperature/humidity sensor 502 serving as an ambient temperature detector. FIG. 11 is a schematic side view of the image forming apparatus incorporating the sheet temperature sensor 501 and the temperature/humidity sensor 502.

The sheet temperature sensor 501 is disposed upstream from a fixing device 200 in the recording media conveyance direction to detect a sheet temperature before a recording medium enters the fixing device 200. FIG. 10 and FIG. 11 illustrate the sheet temperature sensor 501 that detects the temperature of a top one of recording media placed on a sheet feeder 61. The sheet temperature sensor 501 is positioned ahead from the center in a depth direction as illustrated in FIG. 11. FIGS. 10 and 11 also illustrate the temperature/humidity sensor 502 in a lower corner of the image forming apparatus. It is to be noted that the position of the sheet temperature sensor 501 and the position of the temperature/humidity sensor 502 are not limited to those of FIGS. 10 and 11.

Figure 12:
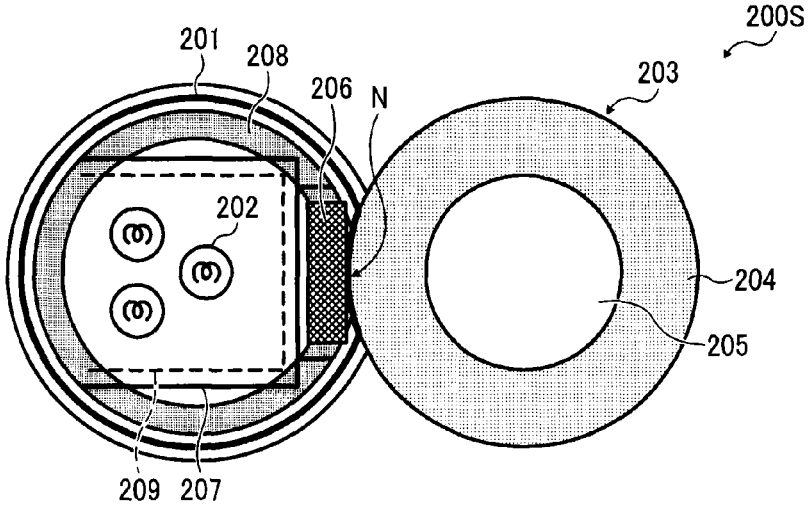
FIG. 12 is a schematic sectional view of a fixing device according to a second example of the first embodiment.

Referring now to FIG. 12, a description is given of a fixing device 200S according to a second example of the first embodiment. FIG. 12 is a schematic sectional view of the fixing device 200S.

As illustrated in FIG. 12, the fixing device 200S includes a fixing belt 201, a nip forming member 206, a stay 207, a flange 208, a reflecting member 209, and three halogen heaters 202 serving as heat sources. Unlike the fixing device 200 of FIG. 2, the fixing device 200S does not include a movable shield. The fixing device 200S also includes a pressing roller 203 constituted of an elastic layer 204 and a bar core 205.

The three halogen heaters 202 have heat-generating areas optimized for A3-width, Letter- (or A4-) width, and postcard width, respectively. While recording media having such width are conveyed, the temperature of the non-sheet-passing areas of the fixing belt 201 serving as a fixing member do not rise.

According to conventional control, the temperature of the non-sheet-passing areas of the fixing member may rise while, e.g., A5-size recording media are conveyed. On the other hand, in the fixing device 200S, the temperature changes as illustrated in FIG. 8, thereby enhancing productivity in the normal or high-temperature environment in which recording media are relatively warm.

Figure 13:
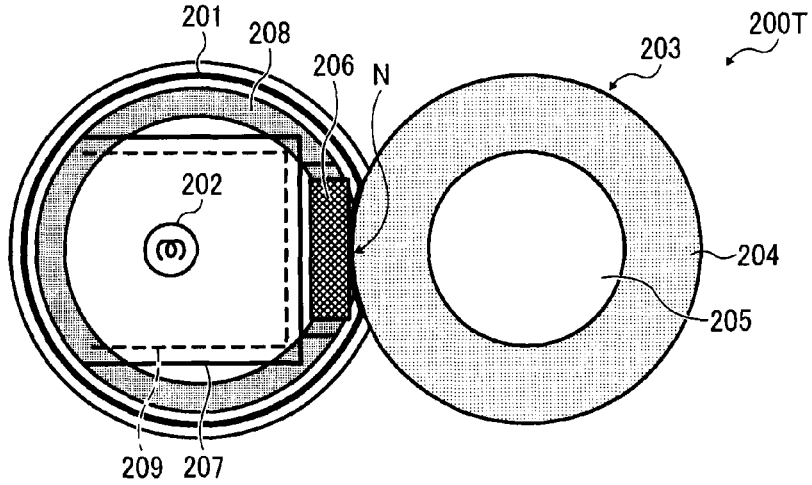
FIG. 13 is a schematic sectional view of a fixing device according to a third example of the first embodiment.

Referring now to FIG. 13, a description is given of a fixing device 200T according to a third example of the first embodiment. FIG. 13 is a schematic sectional view of the fixing device 200T.

As illustrated in FIG. 13, the fixing device 200T includes a fixing belt 201, a nip forming member 206, a stay 207, a flange 208, a reflecting member 209, and a halogen heater 202 serving as heat sources. Unlike the fixing device 200 of FIG. 2, the fixing device 200T does not include a movable shield. The fixing device 200T also includes a pressing roller 203 constituted of an elastic layer 204 and a bar core 205.

The halogen heater 202 has a heat-generating area optimized for Letter (or A4) width. While recording media having Letter- (or A4-) width are conveyed, the temperature of non-sheet-passing areas of the fixing belt 201 serving as a fixing member do not rise. According to conventional control, the temperature of non-sheet-passing areas of the fixing member may rise while, e.g., A5-size recording media are conveyed. On the other hand, in the fixing device 200T, the temperature changes as illustrated in FIG. 8, thereby enhancing productivity in the normal or high-temperature environment in which recording media are relatively warm.

To prevent a temperature drop in the non-sheet-passing areas of the fixing belt 201 when a recording medium starts passing through the fixing device 200T, the halogen heater 202 of the fixing device 200T is longer than Letter- (or A4-) width. Usually, when Letter- (or A4-) size recording media are conveyed continuously, the temperature may rise in the non-sheet-passing areas of the fixing member even if a heater longer than Letter- (or A4-) width is provided. However, according to the present embodiment, the temperature changes as illustrated in FIG. 8, thereby enhancing productivity in the normal or high-temperature environment in which recording media are relatively warm.

Figure 14:
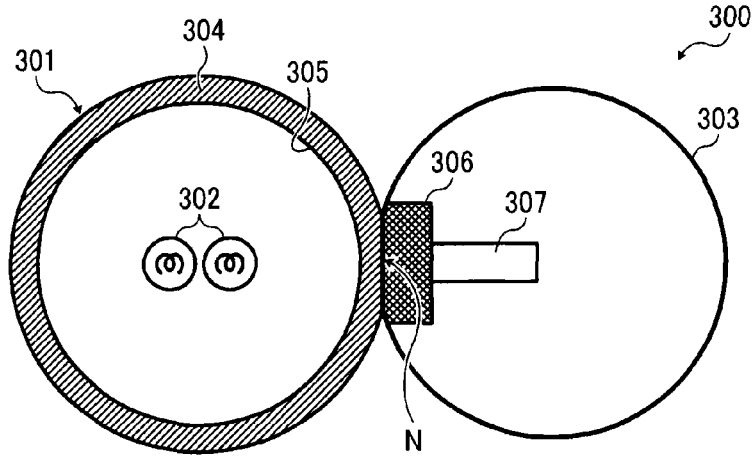
FIG. 14 is a schematic sectional view of a fixing device according to a first example of a second embodiment of the present invention.

Referring now to FIG. 14, a description is given of a fixing device 300 according to a first example of a second embodiment. FIG. 14 is a schematic sectional view of the fixing device 300.

As illustrated in FIG. 14, the fixing device 300 includes a fixing roller 301 serving as a fixing member, a pressing belt 303 serving as a pressing member, and two halogen heaters 302 serving as heat sources. The halogen heaters 302 directly heats the fixing roller 301 from inside the fixing roller 301.

In the present embodiment, the fixing roller 301 is a metal roller. The fixing roller 301 is constituted of an elastic layer 304 as a surface layer and a bar core 305, with a release layer made of PFA or PTFE provided on an outer circumferential surface of the fixing roller 301 to enhance separation. The elastic layer 304 is made of, e.g., silicone rubber. Omitting the elastic layer 304 made of silicone rubber reduces heat capacity and enhances fixability. However, the slight surface roughness of the fixing roller 301 may be transferred onto a recording medium while a toner image is fixed onto the recording medium, causing an orange-peel image, which is an image having uneven gloss in a solid part thereof. The elastic layer 304 made of silicone rubber of 100 μm or greater may prevent such a problem. Deformation of the elastic layer 304 absorbs the slight surface roughness and avoids an orange-peel image.

A drive source such as a motor incorporated in the image forming apparatus 100 transmits a driving force to the fixing roller 301 through gears, thereby rotating the fixing roller 301. The elastic layer 304 is deformed while the fixing roller 301 is pressed against the pressing belt 303 by, e.g., a spring. Such deformation of the elastic layer 304 forms a fixing nip N having a predetermined width.

The pressing belt 303 is an endless belt or film. Specifically, the pressing belt 303 may be a metal belt made of, e.g., nickel or stainless steel, or a belt made of resin material such as polyimide. Like the fixing roller 301, the pressing belt 303 may have an elastic layer as a surface layer and a release layer made of PFA or PTFE to prevent toner from adhering to the pressing belt 303. If an elastic layer is provided between a base material and a release layer, the elastic layer is made of solid rubber or sponge rubber. In some embodiments, the elastic layer made of sponge rubber is used to suppress heat transmission to the pressing belt 303.

The fixing device 300 further includes a nip forming member 306 inside a loop formed by the pressing belt 303. The nip forming member 306 faces the fixing roller 301 through the pressing belt 303, thereby forming a contact area called a fixing nip (i.e., fixing nip N) between the fixing roller 301 and the pressing belt 303. The pressing belt 303 slides over the nip forming member 306 directly, or indirectly via a sheet of material. It is to be noted that although in the embodiment illustrated in FIG. 14 the fixing nip N is flat, in other embodiments the fixing nip may have a concave shape or some other shapes.

Inside the loop formed by the pressing belt 303, a stay 307 serving as a support member is disposed to support the nip forming member 306. The stay 307 supports pressure from the fixing roller 301 with a pressing member support mechanism. The stay 307 prevents deformation of the nip forming member 306 under pressure so that the fixing nip N maintains an even width axially along the fixing roller 301 and the pressing belt 303.

As described above, the fixing roller 301 is pressed against the pressing belt 303 by, e.g., a spring. Alternatively, in some embodiments, the stay 307 is pressed against the nip forming member 306 by, e.g., a spring to press the nip forming member 306 against the fixing roller 301.

The rotation of the fixing roller 301 rotates the pressing belt 303. In the present embodiment, the fixing roller 301 is rotated by a drive source, and a driving force is transmitted to the pressing belt 303 at the fixing nip N to rotate the pressing belt 303. Specifically, the pressing belt 303 is sandwiched between the fixing roller 301 and the nip forming member 306 at the fixing nip N, and therefore, rotates.

It is to be noted that although in the embodiment illustrated in FIG. 14 the halogen heaters 302 serve as heat sources, in other embodiments, e.g., an induction heater, a resistance heat generator, or a carbon heater may serve as a heat source.

The fixing device 300 having the above-described configuration speeds warm-up and is inexpensive.

Figure 15:
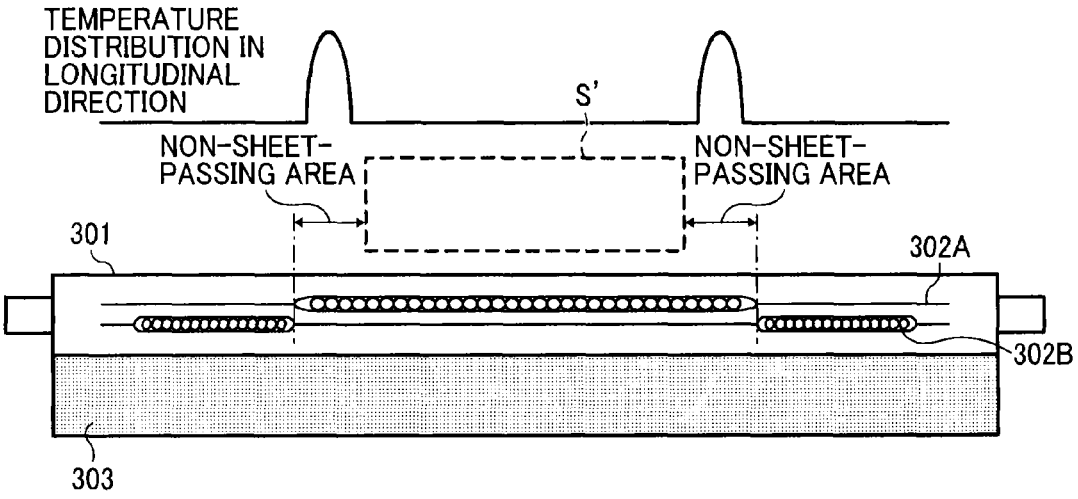
FIG. 15 is a schematic diagram illustrating a temperature rise in non-sheet-passing areas of a fixing member incorporated in the fixing device of FIG. 14.

As illustrated in FIG. 15, the two halogen heaters 302 include a central heater 302A and an end heater 302B. In the present embodiment, a recording sheet S' is conveyed centrally. The central heater 302A has a heat-generating area in the center in a width direction of the recording sheet S', which is a direction perpendicular to the recording media conveyance direction in which the recording sheet S' is conveyed. When the recording sheet S' having a predetermined width or a smaller width is conveyed, the central heater 302A is used alone. For example, when a Letter-size recording sheet S' or a recording sheet S' having a smaller size is conveyed in a longitudinal direction thereof, the central heater 302A is used alone. The end heater 302B has heat-generating areas outside opposed ends of the recording sheet S' in the width direction thereof. The end heater 302B is used with the central heater 302A when the recording sheet S' having a greater width than the predetermined width is conveyed. For example, when a recording sheet S' having a greater width than a Letter-size recording sheet S' is conveyed, the end heater 302B is used with the central heater 302A.

Usually, in fixing devices having two heaters as illustrated in FIG. 14, the heaters are separated from each other, as described above, to prevent a temperature rise in non-sheet-passing areas of a fixing member (e.g., fixing roller) through which a recording medium does not pass. For example, when an A3-, A4-, or Letter-size recording sheet is conveyed in the longitudinal direction thereof, a central heater is used alone to fix a toner image on the sheet, thereby preventing a temperature rise in the non-sheet-passing areas of the fixing member.

However, if, e.g., an A5-size recording sheet is conveyed in the fixing devices having the above-described configuration, the temperature may rise in the non-sheet-passing areas of the fixing member. FIG. 15 illustrates such a temperature rise in the non-sheet-passing areas of the fixing member as a temperature distribution in a longitudinal direction of the fixing member (i.e. fixing roller 301).

Referring back to FIG. 5, the temperature soars in response to a low-temperature environment of the recording medium. In a conventional control regime, a target fixing temperature is increased and an interval between successive recording media is extended to reduce the number of recording media conveyed per hour when the temperature of recording media is relatively low. Thus, FIG. 6 illustrates the temperature of the fixing member does not reach the upper limit of the operable temperature of the fixing member in a normal environment or high-temperature environment in which the recording media are relatively warm. In other words, heat dissipates inefficiently, adversely affecting productivity.

Like the first embodiment, according to the second embodiment, a sheet interval (i.e., a period of time marked off between two recording media conveyed successively) required for dissipation of heat and the time to change the sheet interval are adjusted according to the sheet temperature, as illustrated in FIGS. 7A and 7B. Accordingly, the temperature changes as illustrated in FIG. 8, thereby enhancing productivity in the normal or high-temperature environment in which recording media are relatively warm.

The fixing controls according to the first and second embodiments are identical in adjustment of a predetermined sheet interval and a predetermined time to change the sheet interval according to the sheet temperature. Therefore, a detailed description of the fixing control according to the second embodiment is omitted.

In addition, detection of a temperature rise in non-sheet-passing areas of the fixing roller 301 according to the second embodiment is the same as that according to the first embodiment. Therefore, a detailed description thereof is omitted. Similarly, detection of a sheet temperature according to the second embodiment is the same as that according to the first embodiment. Therefore, a detailed description thereof is omitted.

Figure 16:
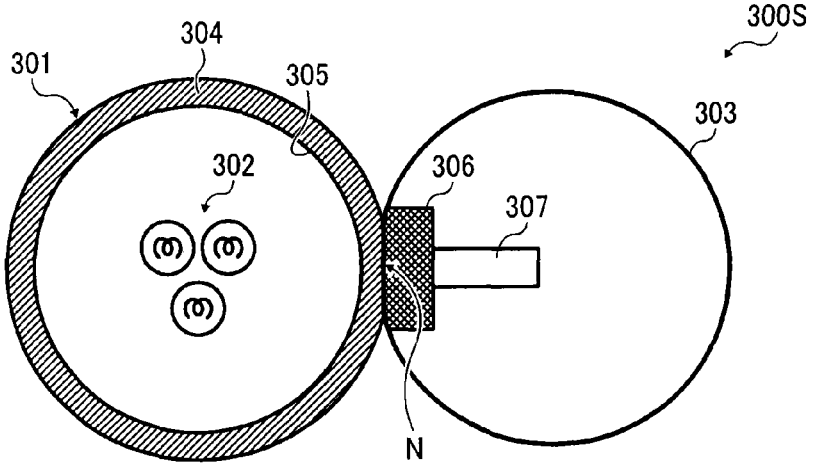
FIG. 16 is a schematic sectional view of a fixing device according to a second example of the second embodiment.

Referring now to FIG. 16, a description is given of a fixing device 300S according to a second example of the second embodiment. FIG. 16 is a schematic sectional view of the fixing device 300S.

The fixing device 300S includes three halogen heaters 302 serving as heat sources. The three halogen heaters 302 have heat-generating areas optimized for A3 width, Letter- (or A4-) width, and postcard width, respectively. While recording media having such width are conveyed, the temperature of non-sheet-passing areas of the fixing roller 301 serving as a fixing member do not rise.

According to conventional control, the temperature of non-sheet-passing areas of the fixing member may rise while, e.g., A5-size recording media are conveyed. On the other hand, in the fixing device 300S, the temperature changes as illustrated in FIG. 8, thereby enhancing productivity in the normal or high-temperature environment in which recording media are relatively warm.

Figure 17:
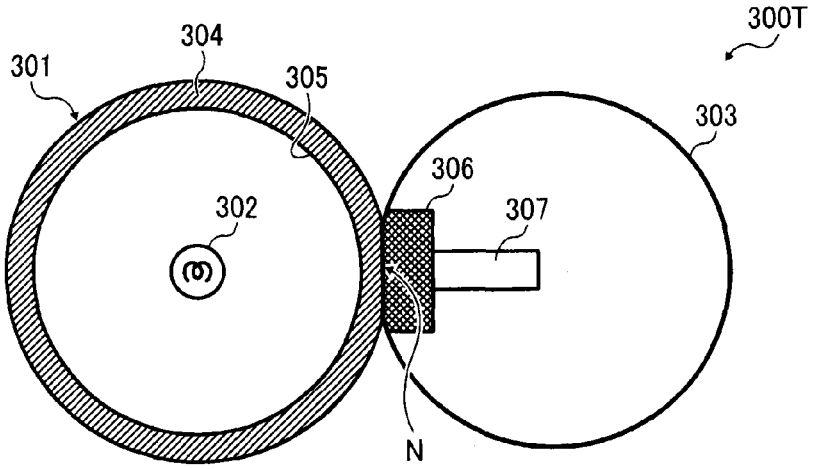
FIG. 17 is a schematic diagram of a fixing device according to a third example of the second embodiment.

Referring now to FIG. 17, a description is given of a fixing device 300T according to a third example of the second embodiment. FIG. 17 is a schematic sectional view of the fixing device 300T.

The fixing device 300T includes a halogen heater 302 serving as a heat source. The halogen heater 302 has a heat-generating area optimized for Letter- (or A4-) width. While recording media having Letter- (or A4-) width are conveyed, the temperature of non-sheet-passing areas of the fixing rollers 301 serving as a fixing member do not rise. According to conventional control, the temperature of non-sheet-passing areas of the fixing member may rise while, e.g., A5-size recording media are conveyed. On the other hand, in the fixing device 300T, the temperature changes as illustrated in FIG. 8, thereby enhancing productivity in the normal or high-temperature environment in which recording media are relatively warm.

As described above, a temperature rise in non-sheet-passing areas of the fixing member in a fixing device depends on ambient temperature, more specifically, the temperature of recording media conveyed. Generally, a target fixing temperature is increased to fix a toner image on a recording medium passing through the fixing device if the recording medium has a relatively low temperature. In this case, the recording medium drains a relatively large amount of heat, and therefore, the temperature rise is relatively large in the non-sheet-passing areas of the fixing member. By contrast, the target fixing temperature is decreased if the recording medium has a relatively high temperature. In this case, the recording medium drains a relatively low amount of heat, and therefore, the temperature rise is relatively small in the non-sheet-passing areas of the fixing member.

Typically, in fixing devices, a sheet interval is determined on the assumption that the sheet temperature is relatively low if a temperature rise is detected in the non-sheet-passing areas of the fixing member. Such determination may lengthen the sheet interval excessively and cause inefficient dissipation of heat when the sheet temperature is relatively high, hampering enhancement of usability.

On the other hand, according to embodiments of the present invention, the sheet interval is changed (controlled) after detection of a temperature rise in the non-sheet-passing areas of the fixing member and the time to change the sheet interval is changed (controlled) according to the sheet temperature to maintain the temperature of the non-sheet-passing areas of the fixing member equal to or lower than a predetermined temperature while ensuring a sufficient heat dissipation time. As a result, energy efficiency is enhanced in various environments and productivity is also enhanced.

In some embodiments, the sheet temperature is measured before a recording medium enters the fixing nip (e.g., fixing nip N) to acquire appropriate detection results.

A recording medium temperature detector that directly detects the sheet temperature contributes to acquisition of an accurate sheet temperature.

Alternatively, in some embodiments, ambient temperature detected by an ambient temperature detector is substituted for the sheet temperature. In short, the sheet temperature is acquired indirectly, thereby reducing production costs.

Alternatively, in some embodiments, a recording medium temperature calculator calculates a temperature of a recording medium as a sheet temperature, which is predicted based on a duty ratio of power supplied to a heat source (e.g., halogen heater 202) while a recording medium passes through the fixing nip, thereby reducing production costs.

It is to be noted that the temperature of a recording medium is determined based on one or more of the temperature detected by the recording medium temperature detector, the ambient temperature detected by the ambient temperature detector, and the temperature calculated by the recording medium temperature calculator, to acquire an appropriate sheet temperature according to configuration of device or installation environment.

Numerous additional modifications and variations are possible in light of the above teachings. It is therefore to be understood that within the scope of the appended claims, the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of the present invention and appended claims.

For example, the number and location of heat sources provided in the fixing device is arbitrarily determined. The heat source is not limited to the halogen heater, but can be any appropriate heat source such as an induction heater. In addition, the fixing member such as a belt or film has any appropriate material and the pressing member has any appropriate configuration.

The configuration of the image forming apparatus is arbitrarily determined. Instead of employing toner of four colors, a full-color machine employing toner of three colors may be used. Alternatively, a multicolor machine employing toner of two colors or a monochrome machine may be used. The image forming apparatus is not limited to a printer. Alternatively, the image forming apparatus may be a copier, a facsimile machine, or a multifunction peripheral having a plurality of capabilities.

Further, any of the above-described devices or units can be implemented as a hardware apparatus, such as a special-purpose circuit or device, or as a hardware/software combination, such as a processor executing a software program.

What is claimed is:

1. An image forming apparatus comprising:

a fixing member;

a heat source to heat the fixing member;

a nip forming member disposed inside the fixing member;

a pressing member pressed against the nip forming member through the fixing member to form a fixing nip through which a recording medium passes;

a recording medium conveyor to convey the recording medium to the fixing nip;

a first temperature detector to detect a temperature of a non-sheet-passing area of the fixing member through which the recording medium does not pass;

a second temperature detector to detect a temperature of the recording medium; and a controller to adjust a time to drive the recording medium conveyer to control a time interval between successive recording media and a changing time to change the time interval, according to a temperature detected by the second temperature detector in response to a temperature rise in the non-sheet-passing area of the fixing member detected by the first temperature detector.

2. The image forming apparatus according to claim 1, wherein the fixing member comprises one of a belt and a film.

3. The image forming apparatus according to claim 1, wherein the pressing member comprises a roller.

4. The image forming apparatus according to claim 1, wherein the controller controls the time interval to be shorter than a predetermined time interval and the changing time to be later than a predetermined changing time in response to a temperature detected by the second temperature detector equal to or greater than a predetermined value, and wherein the controller controls the time interval to be longer than the predetermined time interval and the changing time to be earlier than the predetermined changing time in response to a temperature detected by the second temperature detector smaller than the predetermined value.

5. The image forming apparatus according to claim 1, wherein the second temperature detector comprises a recording medium temperature detector to detect a temperature of the recording medium before the recording medium enters the fixing nip.

6. The image forming apparatus according to claim 1, wherein the second temperature detector comprises an ambient temperature detector to detect ambient temperature.

7. The image forming apparatus according to claim 1, wherein the second temperature detector comprises a recording medium temperature calculator to calculate a temperature of the recording medium predicted based on a duty ratio of power supplied to the heat source while the recording medium passes through the fixing nip.

8. The image forming apparatus according to claim 1, wherein the second temperature detector comprises one or more of a recording medium temperature detector to detect a temperature of the recording medium, an ambient temperature detector to detect ambient temperature, and a recording medium temperature calculator to calculate a temperature of the recording medium predicted based on a duty ratio of power supplied to the heat source while the recording medium passes through the fixing nip, and wherein the controller determines the temperature of the recording medium based on one or more of the temperature detected by the recording medium temperature detector, the ambient temperature detected by the ambient temperature detector, and the temperature calculated by the recording medium temperature calculator.

9. An image forming apparatus comprising:

a fixing member;

a heat source to heat the fixing member;

a pressing member to form, together with the fixing member, a fixing nip through which a recording medium passes;

a nip forming member, disposed inside the pressing member, facing the fixing member to form the fixing nip;

a recording medium conveyor to convey the recording medium to the fixing nip;

a first temperature detector to detect a temperature of a non-sheet-passing area of the fixing member through which the recording medium does not pass;

a second temperature detector to detect a temperature of the recording medium; and a controller to adjust a time to drive the recording medium conveyer to control a time interval between successive recording media and a changing time to change the time interval, according to a temperature provided by the second temperature detector in response to a temperature rise in the non-sheet-passing area of the fixing member detected by the first temperature detector.

10. The image forming apparatus according to claim 9, wherein the fixing member comprises a roller.

11. The image forming apparatus according to claim 9, wherein the pressing member comprises one of a belt and a film.

12. The image forming apparatus according to claim 9, wherein the controller controls the time interval to be shorter than a predetermined time interval and the changing time to be later than a predetermined changing time in response to a temperature detected by the second temperature detector equal to or greater than a predetermined value, and wherein the controller controls the time interval to be longer than the predetermined time interval and the changing time to be earlier than the predetermined changing time in response to a temperature detected by the second temperature detector smaller than the predetermined value.

13. The image forming apparatus according to claim 9, wherein the second temperature detector comprises a recording medium temperature detector to detect a temperature of the recording medium before the recording medium enters the fixing nip.

14. The image forming apparatus according to claim 9, wherein the second temperature detector comprises an ambient temperature detector to detect ambient temperature.

15. The image forming apparatus according to claim 9, wherein the second temperature detector comprises a recording medium temperature calculator to calculate a temperature of the recording medium predicted based on a duty ratio of power supplied to the heat source while the recording medium passes through the fixing nip.

16. The image forming apparatus according to claim 9, wherein the second temperature detector comprises one or more of a recording medium temperature detector to detect a temperature of the recording medium, an ambient temperature detector to detect ambient temperature, and a recording medium temperature calculator to calculate a temperature of the recording medium predicted based on a duty ratio of power supplied to the heat source while the recording medium passes through the fixing nip, and wherein the controller determines the temperature of the recording medium based on one or more of the temperature provided by the recording medium temperature detector, the ambient temperature detected by the ambient temperature detector, and the temperature calculated by the recording medium temperature calculator.

* * * * *